US006243114B1

(12) United States Patent
Yano et al.

(10) Patent No.: US 6,243,114 B1
(45) Date of Patent: Jun. 5, 2001

(54) INK JET HEAD PROVIDING IMPROVED PRINTING RESOLUTION AND PRINTING SPEED

(75) Inventors: Akio Yano; Akihiko Miyaki; Masahiro Ono; Takumi Kawamura, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/170,263

(22) Filed: Oct. 13, 1998

(30) Foreign Application Priority Data

Nov. 27, 1997 (JP) ..... 9-326808

(51) Int. Cl.[7] ..... H04R 17/00
(52) U.S. Cl. ..... 347/68
(58) Field of Search ..... 347/68–71, 72; 399/261

(56) References Cited

U.S. PATENT DOCUMENTS 5,901,425 * 5/1999 Bibl et al. ..... 29/25.35

FOREIGN PATENT DOCUMENTS 2-266948 10/1990 (JP) .
3-166950 7/1991 (JP) .
3-166951 7/1991 (JP) .
6-166950 7/1991 (JP) .
8-25626 1/1996 (JP) .

* cited by examiner

*Primary Examiner*—Safet Metjahic
*Assistant Examiner*—Raquel Yvette Gordon
(74) *Attorney, Agent, or Firm*—Armstrong, Westerman, Hattori, McLeland & Naughton

(57) ABSTRACT

Each of common electrode teeth 76-1, 76-2 and 76-3, and each of individual electrode teeth 77-1 and 77-2 are alternately arranged in the X1–X2 direction at predetermined intervals g. When a positive voltage is applied to the individual electrode teeth 77-1 and 77-2, an electric field 83-1 indicated by a line of electric force 82-1 is produced in a piezoelectric plate member 65 between the individual electrode tooth 77-1 and the common electrode tooth 76-1 and an electric field 83-2 indicated by a line of electric force 82-2 is produced between the individual electrode tooth 77-1 and the common electrode tooth 76-2. Likewise, an electric field 83-3 indicated by a line of electric force 82-3 is produced between the individual electrode tooth 77-2 and the common electrode tooth 76-2 and an electric field 83-4 indicated by a line of electric force 82-4 is produced between the individual electrode tooth 77-2 and the common electrode tooth 76-3. Depending on the piezoelectric constant d33, X1–X2 direction components of the electric fields causes the piezoelectric plate member 65 to expand efficiently, as indicated by numerals 83-1–83-4. An expanding action of the piezoelectric plate member 65 causes a bimorph element 69 to bulge into a dome configuration.

5 Claims, 5 Drawing Sheets

INK JET HEAD PROVIDING IMPROVED PRINTING RESOLUTION AND PRINTING SPEED

BACKGROUND OF THE INVENTION

1. Field of the Invention

The present invention generally relates to ink jet heads and, more particularly, to an ink jet head for use in an ink jet printer constructed such that a piezoelectric plate member is deformed to have a dome configuration so as to cause the volume of a pressure chamber to vary and cause the ink in the pressure chamber to be ejected.

There is a demand for an ink jet printer to have an improved printing resolution and printing speed. In order to meet such a demand, the operation for deforming the piezoelectric plate member to bulge into a dome configuration should be performed efficiently.

2. Description of the Related Art

FIG. 1A is a partial front sectional view of an ink jet head 10 showing a pressure chamber 11 of a plurality of pressure chambers provided in the ink jet head 10; FIG. 1B is a partial enlarged view of the ink jet head 10 of FIG. 1A; FIG. 1C is a lateral sectional view of the ink jet head 10 of FIG. 1A; and FIG. 1D is a bottom view of the ink jet head 10 of FIG. 1A.

In the ink jet head 10, the volume of the pressure chamber 11 containing the ink is cyclically reduced and restored by cyclically deforming an oscillating plate 13 (for example, a stainless plate of a thickness of 20 $\mu$m) and returning it to an original state. When the volume of the pressure chamber 11 is reduced, ink particles 15 (approximately 80 pl) are ejected from a nozzle 14. When the volume of the pressure chamber 11 is restored to an original level, the ink inside a common passage 16 is supplied to the pressure chamber 11 via an ink supplying passage 17.

The ink jet head 10 further comprises barriers 20 and 21, a top plate 22, a nozzle plate 23 and a piezoelectric plate member 25.

The piezoelectric plate member 25 has a common electrode 26 on the upper surface thereof and an individual electrode 27 on the lower surface thereof. The piezoelectric plate member 25 is attached to the lower surface of the oscillating plate 13 via a adhesive layer 28. The oscillating plate 13 and the piezoelectric plate member 25 are integral with each other so as to form a flat bimorph element 29.

The pressure chamber 11 generally has a rectangular solid configuration. The oscillating plate 13 constitutes a bottom plate for the pressure chamber 11 and has all four sides thereof adhesively attached to the chamber 11.

As shown in FIG. 1D, the common electrode 26 and the individual electrode 27 both have a rectangular configuration of a size that corresponds to the size of the bottom of the pressure chamber 11.

A voltage is applied across the individual electrode 27 and the common electrode 26 so that the piezoelectric plate member 25 is polarized in a direction of the thickness thereof.

The piezoelectric plate member 25 has a piezoelectric constant d33 in a direction of the polarization (that is, in the direction of the thickness) of the piezoelectric plate member 25, and a piezoelectric constant d31 in a direction perpendicular to the direction of polarization (that is, in the direction along the plane). Distortion caused by expansion and contraction of the piezoelectric plate member 25 is determined by the intensity of the electric field exerted on the piezoelectric plate member 25×piezoelectric constant.

Generally, the piezoelectric constant d33 is larger than the piezoelectric constant d31 such that d33 may be twice as large as d31.

The ink jet head 10 is capable of printing at a resolution of 300 dpi. A distance a between the adjacent nozzles 14 (equal to a distance between the barriers 20 and 21) is 0.339 mm. An area S1 of a bottom of the pressure chamber 11 is a×b.

A description will now be given of bulging distortion the bimorph element 29.

When a switch 40 shown in FIG. 1A is closed, a voltage from a power source 41 is applied to the individual electrode 27 so that an electric field 42 indicated by the arrows is produced between the individual electrode 27 and the common electrode 26 of the piezoelectric plate member 25 in the direction of the thickness of the bimorph 29. As a result, the piezoelectric plate member 25 expands in a direction indicated by an arrow 43 and contracts in a direction indicated by an arrow 44 in a plane direction perpendicular to the direction of the electric field 42. Due to the contraction of the piezoelectric plate member 25 in the plane direction, the bimorph element 29 bulges into a dome configuration, as indicated by the alternate long and two short dashes line. When the switch 40 is grounded, the electric field 42 is removed so that the distortion due to the contraction and the expansion is gone. The bimorph element 29 is restored to a flat state due to elasticity of the oscillating plate 13.

Since d31<d33, the efficiency of contraction of the piezoelectric plate member 25 in the direction along the plane is lower than the corresponding efficiency in the direction of the polarization. The efficiency with which the bimorph element 29 is bulged into a dome configuration is not satisfactory.

As a result, the ink particles 15 ejected from the nozzle 14 may be insufficient in volume for proper printing, if the pressure chamber 11 is relatively small. For this reason, reduction of the size of the pressure chamber 11 is difficult. Thus, the goals of improving the printing resolution and printing speed are difficult to achieve.

SUMMARY OF THE INVENTION

Accordingly, a general object of the present invention is to provide an ink jet head in which the aforementioned problems are eliminated.

Another and more specific object is to provide an ink jet head with which the printing resolution and the printing speed are improved.

The aforementioned objects can be achieved by an ink jet head comprising: a pressure chamber containing ink; a piezoelectric plate member which constitutes a portion of a wall of the pressure chamber and bulges to cause distortion when a voltage is applied to the piezoelectric plate member; a first set of electrodes; and a second set of electrodes; wherein the first set of electrodes and the second set of electrodes being arranged such that an electric field produced in the piezoelectric plate member is orientated so as to have components in a direction along a plane of the piezoelectric plate member so that distortion in the direction along a plane of the piezoelectric plate member due to the components causes the piezoelectric plate member to bulge.

According to the ink jet head of the present invention, the piezoelectric plate member is distorted depending on the piezoelectric constant d33. Distortion that depends on the piezoelectric constant d33 takes place more efficiently than that of the piezoelectric constant d31. Accordingly, given that the same voltage as used in the related art is used, the degree of bulging is improved. Thus, given the same amount of ejection of ink particles, the pressure chamber can be reduced in size so that the nozzle pitch is reduced and the printing resolution is increased from the current 300 dpi. By reducing the size of the pressure chamber, the size of the piezoelectric plate member corresponding to one pressure chamber is reduced so that the natural frequency of the piezoelectric plate member can be increased. Thus, the frequency of the driving signal from the driving circuit can be increased. By increasing the frequency of the driving signal, the printing speed can be improved.

Another aspect of the ink jet head of the invention is that, given the same amount of ejection of ink particles, the voltage from the power source can be reduced so that the power consumption can be reduced. The cost of fabricating the driving circuit can be reduced.

In further accordance with the present invention, each of the first set of electrodes and each of the second set of electrodes may be alternately arranged on the same surface of the piezoelectric plate member at predetermined intervals so that the electric field is produced in an interior of the piezoelectric plate member between adjacent electrodes.

According to this aspect of the invention, the electric field having components in the direction along the plane of the piezoelectric plate member can be efficiently formed. Since the first and second sets of electrodes are formed on the same surface of the piezoelectric plate member, the electrodes are formed relatively easily.

One of the first and second sets of electrodes may be provided on an upper surface of the piezoelectric plate member and the other of the first and second sets of electrodes is provided on a lower surface of the piezoelectric plate member, each of the first set of electrodes and each of the second set of electrodes being alternately arranged in the direction along the plane of the piezoelectric plate member at predetermined intervals, and the electric field may be produced in an interior of the piezoelectric plate member between adjacent electrodes.

According to this aspect of the invention, the lines of electric force substantially do not leak to the air so that the electric field having components in the direction along the plane of the piezoelectric plate member can be even more efficiently produced.

The piezoelectric plate member may be adhesively attached to an oscillating plate in a state in which the first set of electrodes and the second set of electrodes are formed.

According to this aspect of the invention, a bimorph construction is provided so that distortion can be efficiently converted into bulge.

The aforementioned objects can also be achieved by an ink jet head comprising: a pressure chamber containing ink; a piezoelectric plate member which constitutes a portion of a wall of the pressure chamber and bulges to cause distortion when a voltage is applied to the piezoelectric plate member; a first set of electrodes; and a second set of electrodes; wherein the first set of electrodes and the second set of electrodes being arranged such that an electric field produced in the piezoelectric plate member is orientated so as to have components in a direction along a plane of the piezoelectric plate member, the piezoelectric plate member has both ends in the direction along the plane thereof fixed, and distortion in the direction along a plane of the piezoelectric plate member due to the components causes the piezoelectric plate member to bulge.

According to this aspect of the invention, the piezoelectric plate member can be caused to bulge efficiently due to distortion of the piezoelectric plate member in the direction along the plane thereof.

BRIEF DESCRIPTION OF THE DRAWINGS

Other objects and further features of the present invention will be apparent from the following detailed description when read in conjunction with the accompanying drawings, in which.

DETAILED DESCRIPTION OF THE PREFERRED EMBODIMENTS

Figure 1A:
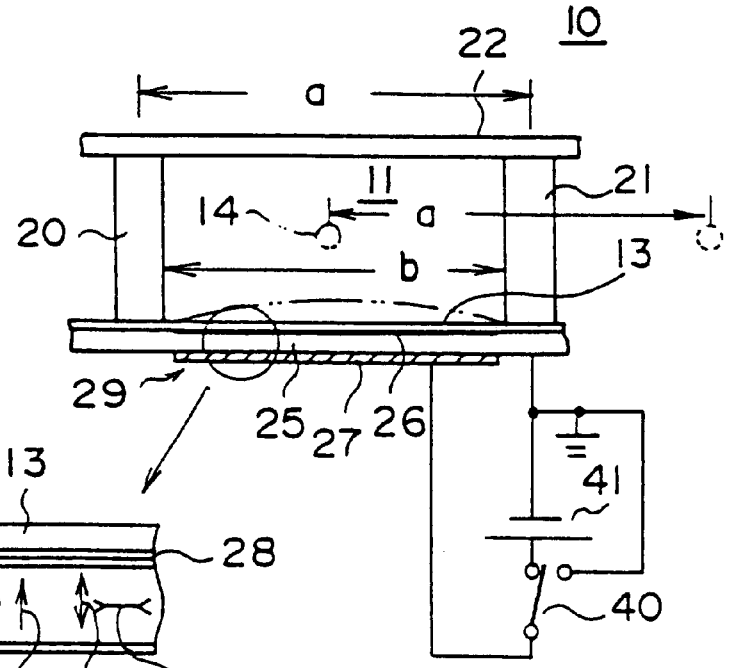
FIG. 1A PRIOR ART
FIG. 1A is a partial front sectional view of an ink jet head showing one of a plurality of pressure chambers provided in the ink jet head.
Figure 1B:
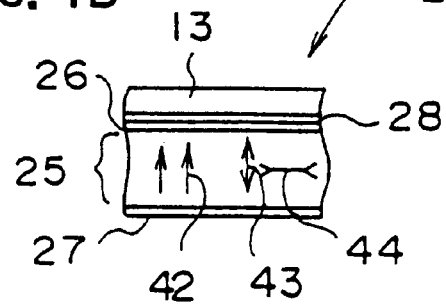
FIG. 1B PRIOR ART
FIG. 1B is an partial enlarged view of the ink jet head of FIG. 1A.
Figure 1C:
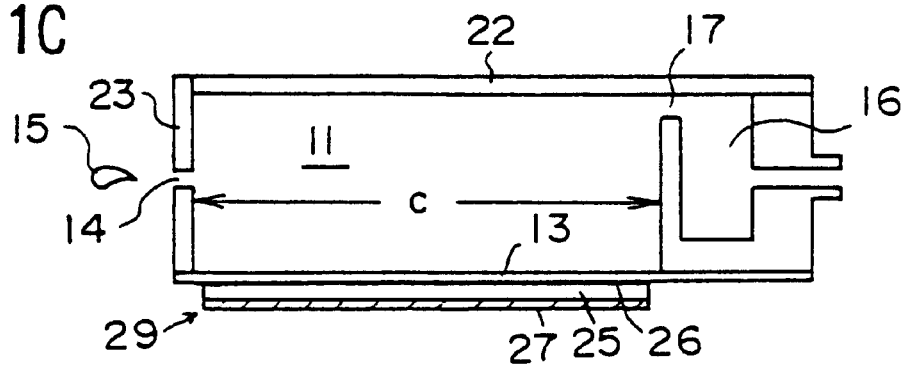
FIG. 1C PRIOR ART
FIG. 1C is a lateral sectional view of the ink jet head of FIG. 1A.
Figure 1D:
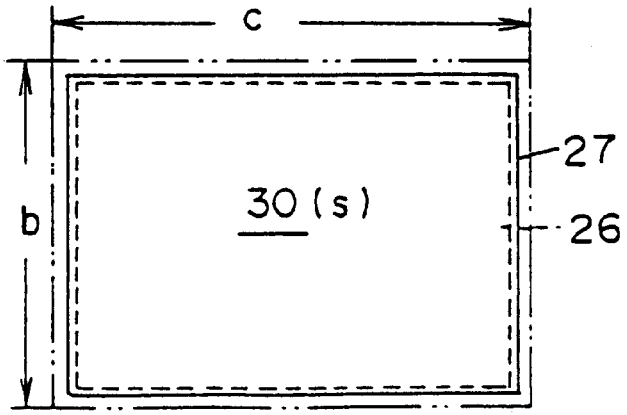
FIG. 1D PRIOR ART
FIG. 1D is a bottom view of the ink jet head of FIG. 1A.
Figure 2A:
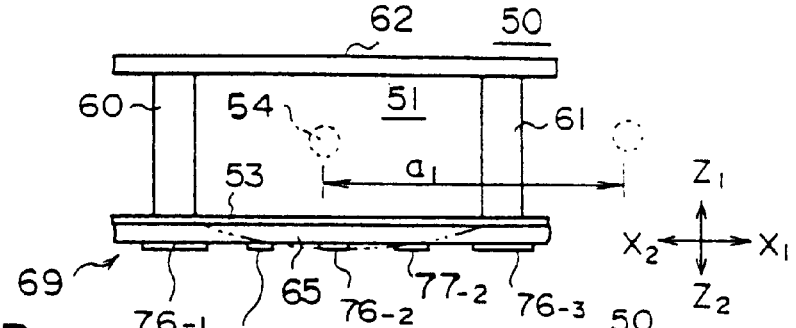
FIG. 2A is a partial front sectional view of an ink jet head according to a first embodiment of the present invention, showing one of a a plurality of pressure chambers provided in the ink jet head.
Figure 2B:
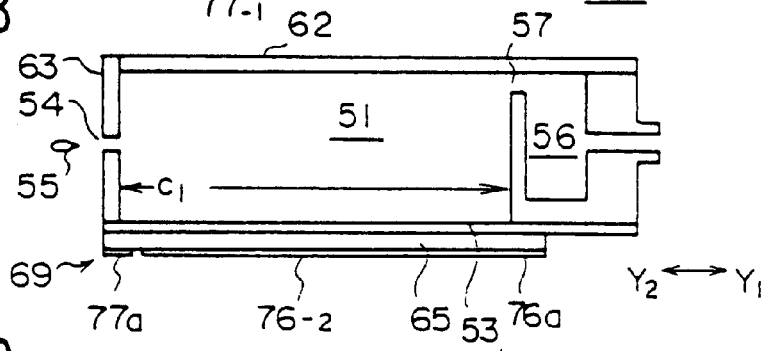
FIG. 2B is a lateral sectional view of the ink jet head of FIG. 2A.
Figure 2C:
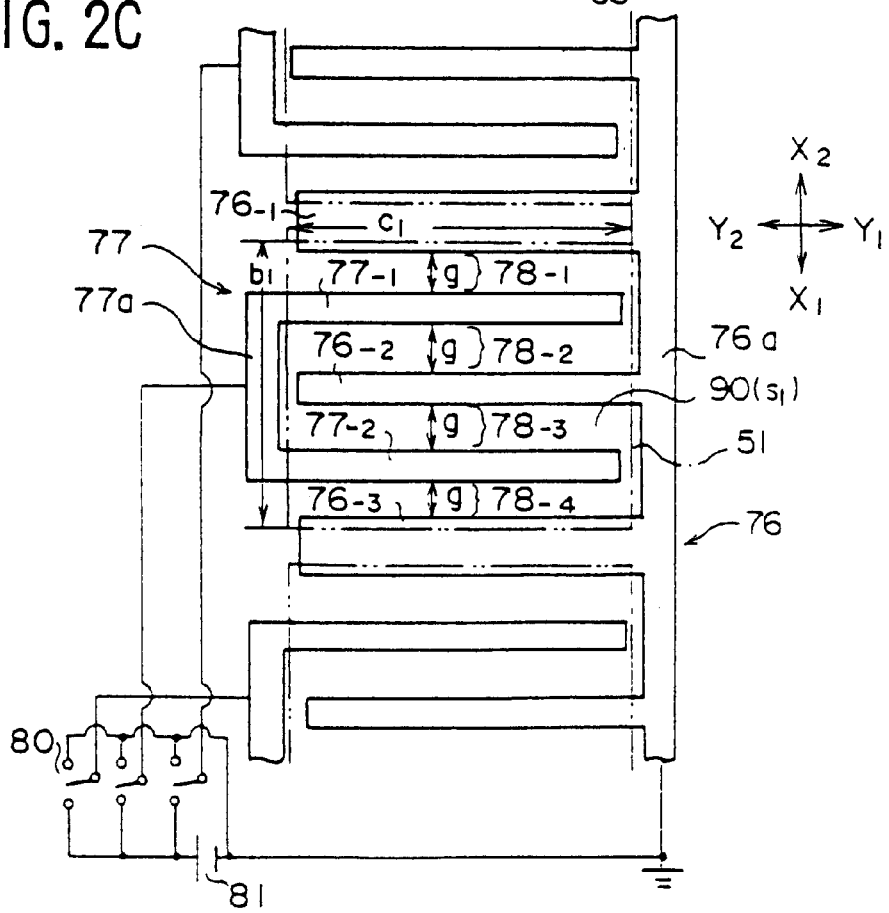
FIG. 2C is a bottom view of the ink jet head of FIG. 2A showing an arrangement of electrode teeth.
Figure 3:
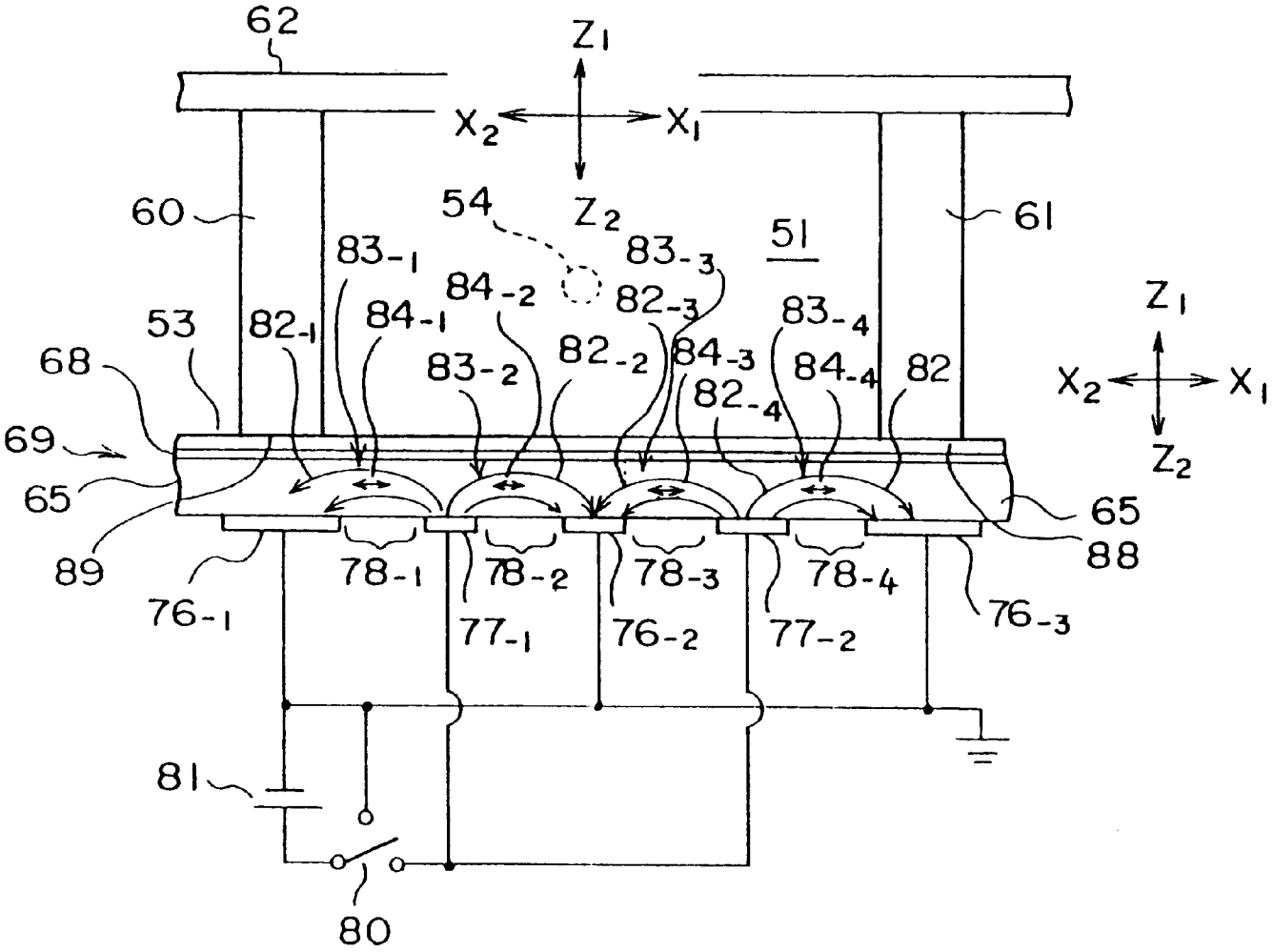
FIG. 3 illustrates formation of electric fields according to the first embodiment.

FIG. 2A is a partial front sectional view of an ink jet head 50 according to a first embodiment of the present invention, showing a pressure chamber 51 of a plurality of pressure chambers provided in the ink jet head 50; FIG. 2B is a lateral sectional view of the ink jet head 50 of FIG. 2A; and FIG. 2C is a bottom view of the ink jet head 50 of FIG. 2A showing an arrangement of electrode teeth. FIG. 3 illustrates formation of electric fields according to the first embodiment.

In the ink jet head 50, the volume of the pressure chamber 51 containing the ink is cyclically expanded and restored by cyclically deforming an oscillating plate 53 (for example, a stainless plate of a thickness of 20 $\mu$m) and returning it to an original state. When the volume of the pressure chamber 51 is expanded, the ink inside a common passage 56 is supplied to the pressure chamber 51 via an ink supplying passage 57. When the volume of the pressure chamber 51 is restored to an original level, ink particles 55 are ejected from a nozzle 54.

The ink jet head 50 further comprises barriers 60 and 61, a top plate 62, a nozzle plate 63.

X1 and X2 indicate directions of the width of the pressure chamber 51; Y1 and Y2 indicate directions of the length of the pressure chamber 51; and Z1 and Z2 indicate directions of the height of the pressure chamber 51.

The ink jet head 50 further comprises a piezoelectric plate member 65 attached to the lower surface of the oscillating plate 53 via an adhesive layer 68. The oscillating plate 53 and the piezoelectric plate member 65 are integral with each other so as to form a bimorph element 69 which remains flat while no distortion occurs.

The pressure chamber 51 generally has a rectangular polyhedral configuration. The oscillating plate 53 constitutes a bottom plate for the pressure chamber 51 and has all four sides thereof adhesively attached to the lower surface of the barriers 60 and 61.

The piezoelectric plate member 65 has a common electrode pattern 76 and an individual electrode pattern 77 formed on the lower surface thereof. The common electrode pattern 76 and the individual electrode pattern 77 have a comb-like configuration lying in the Y1–Y2 direction. Each tooth of the comb formed by the common electrode pattern 76 is spaced apart from a respective tooth of the individual electrode pattern 77 by a predetermined distance in the X1–X2 direction. The teeth of the common electrode 76 are connected to each other by a joint part 76*a*.

Three common electrode teeth 76-1, 76-2 and 76-3 of the common electrode pattern 76 are aligned with the left end, the center and the right end of the pressure chamber 51, respectively. Two individual electrode teeth 77-1 and 77-2 of the individual electrode pattern 77 are aligned with the pressure chamber 51. The individual electrode tooth 77-1 is disposed between the common electrode teeth 76-1 and 76-2 in the X1–X2 direction. The individual electrode tooth 77-2 is disposed between the common electrode teeth 76-2 and 76-3 in the X1–X2 direction. That is, the common electrode teeth 76-1, 76-2 and 76-3, and the individual electrode teeth 77-1 and 77-2 are arranged in the X1–X2 direction at intervals of g in the X1–X2 direction. The individual electrode teeth 77-1 and 77-2 are connected to each other by a joint part 77*a*.

The piezoelectric plate member 65 is exposed at the intervals g. Referring to FIG. 2C, numeral 78-1 indicates a portion of the piezoelectric plate member 65 between the individual electrode tooth 77-1 and the common electrode tooth 76-1; numeral 78-2 indicates a portion of the piezoelectric plate member 65 between the individual electrode tooth 77-1 and the common electrode tooth 76-2; numeral 78-3 indicates a portion of the piezoelectric plate member 65 between the individual electrode tooth 77-2 and the common electrode tooth 76-2; and numeral 78-4 indicates a portion of the piezoelectric plate member 65 between the individual electrode tooth 77-2 and the common electrode tooth 76-3.

The other pressure chambers provided in the ink jet head 50 also have the same construction as described above.

A voltage is applied across the individual electrode pattern 77 and the common electrode pattern 76 so as to induce polarization. The piezoelectric plate member 65 is polarized in the X1–X2 direction in accordance with the arrangement of the individual electrode teeth and the common electrode teeth. The piezoelectric plate member portions 78-1 and 78-3 are polarized in the same direction. The piezoelectric plate member portions 78-2 and 78-4 are polarized in the same direction. The direction in which the piezoelectric plate member portions 78-1 and 78-3 are polarized is opposite to the direction in which the piezoelectric plate member portions 78-2 and 78-4 are polarized.

The piezoelectric plate member 65 has a piezoelectric constant d33 in a direction of the polarization (that is, in the X1–X2 direction along the plane) of the piezoelectric plate member 65, and a piezoelectric constant d31 in a direction perpendicular to the direction of polarization (that is, in the Z1–Z2 direction along the thickness). Distortion caused by expansion and contraction of the piezoelectric plate member 65 is determined by the intensity of the electric field exerted on the piezoelectric plate member 65 x piezoelectric constant. For example, the piezoelectric constant d31 may be $300\times10^{12}$ C/N. Generally, the piezoelectric constant d33 is larger than the piezoelectric constant d31 such that d33 may be twice as large as d31. The first embodiment takes advantage of contraction due to the piezoelectric constant d33.

A description will now be given of bulging distortion the bimorph element 69.

Referring to FIG. 3, when a switch 80 is closed, a positive voltage from a power source 81 is applied to the individual electrode teeth 77-1 and 77-2. An electric field 83-1 indicated by a line of electric force 82-1 is produced between the individual electrode tooth 77-1 and the common electrode tooth 76-1. An electric field 83-2 indicated by a line of electric force 82-2 is produced between the individual electrode tooth 77-1 and the common electrode tooth 76-2. An electric field 83-3 indicated by a line of electric force 82-3 is produced between the individual electrode tooth 77-2 and the common electrode tooth 76-2. An electric field 83-4 indicated by a line of electric force 82-4 is produced between the individual electrode tooth 77-2 and the common electrode tooth 76-3. Since the dielectric constant of the piezoelectric plate member 65 is far larger than that of the air, the number of lines of electric force passing through a space outside the piezoelectric plate member 65 is relatively small. The lines of electric force 82-1, 82-2, 82-3 and 82-4 generally pass through the piezoelectric plate member 65 so as to form a respective electric field inside the piezoelectric plate member 65.

X1–X2 direction components of the electric fields 83-1–83-4 are larger than the Z1–Z2 direction components thereof.

The Z1–Z2 direction components of the electric fields 83-1–83-4 cause the piezoelectric plate member 65 to expand in the direction of the thickness thereof depending on the piezoelectric constant d33 and to contract in the direction along the plane depending on the piezoelectric constant d31. Since the Z1–Z2 direction components of the electric fields 83-1–83-4 are relatively small so that the contraction in the direction along the plane due to the Z1–Z2 direction components of the electric fields 83-1–83-4 are significantly small, the following description assumes that the contraction in the direction along the plane is negligibly small.

A description will now be given of distortion due to expansion of the piezoelectric plate member 65 in the direction along the plane caused by the electric fields 83-1–83-4. As indicated by numeral 84-1, the piezoelectric plate member portion 78-1 is efficiently distorted by expansion due to the X1 component of the electric field 83-1 depending on the piezoelectric constant d33. As indicated by numeral 84-2, the piezoelectric plate member portion 78-2 is efficiently distorted by expansion due to the X2 component of the electric field 83-2 depending on the piezoelectric constant d33. As indicated by numeral 84-3, the piezoelectric plate member portion 78-3 is efficiently distorted by expansion due to the X1 component of the electric field 83-3 depending on the piezoelectric constant d33. As indicated by numeral 84-4, the piezoelectric plate member portion 78-4 is efficiently distorted by expansion due to the X2 component of the electric field 83-4 depending on the piezoelectric constant d33. Accordingly, the piezoelectric plate member 65 is efficiently distorted by expansion in the X1–X2 direction.

The bimorph element 69 has the X1 end thereof secured to the lower surface of the barrier 61 at an anchor part 88 and has the X2 end thereof secured to the lower surface of the barrier 60 at an anchor part 89. Since the bimorph element 69 has the X1 end and the X2 end thereof fixed, expansion of the piezoelectric plate member 65 in the direction along the plane thereof causes the bimorph element 69 to bulge in the Z2 direction so as to have a dome configuration, as indicated by the alternate long and two short dashes line in FIG. 2A. When the switch 80 is grounded, the electric fields 83-1–83-4 are removed so that distortion due to expansion and contraction is gone. The bimorph 69 is restored to a flat state due to elasticity of the oscillating plate 53.

When the bimorph element 69 bulges into a dome configuration, the ink inside the common passage 56 is supplied to the pressure chamber 51 via the ink supplying passage 57. When the bimorph element 69 is restored to a flat state, the ink particles 55 (approximately 80 pl) are ejected from the nozzle 54.

By operating another one of the switches 80 of FIG. 2C, the associated portion of the bimorph 69 that corresponds to another pressure chamber is caused to bulge.

Since the expansion and contraction due to the piezoelectric constant d33 is utilized, the ink jet head 50 provides the following advantages over the conventional ink jet head 10 shown in FIGS. 1A through 1D.

(1) In case the same voltage as used in the conventional ink jet head is used:

The magnitude of the dome-like bulge is increased. Accordingly, given the same volume of ejection of the ink particles 55, the area S1 of a bottom 90 of the pressure chamber 51 may be smaller in correspondence with the increase of the magnitude of the dome-like bulge. That is, the width b1 of the pressure chamber 51 in the X1–X2 direction may be reduced so that the pitch al between adjacent nozzles 64 is reduced and the printing resolution may be increased from the current 300 dpi.

By reducing the area S1 of the bottom 90 of the pressure chamber 51, the natural oscillation frequency of the bimorph 69 constituting the bottom of the pressure chamber 51 can be increased to, for example, 14 kHz in contrast to the current 7 kHz. Thus, the frequency of a driving signal from a driving circuit can be increased. By increasing the frequency of the driving signal, the speed of printing can be increased.

(2) In case the volume of ejection of the ink particles 55 is controlled to be the same as the conventional volume:

According to the invention, the voltage of the power source 81 can be reduced so that power consumption can be reduced. The cost of fabricating the driving circuit can be reduced.

Figure 4A:
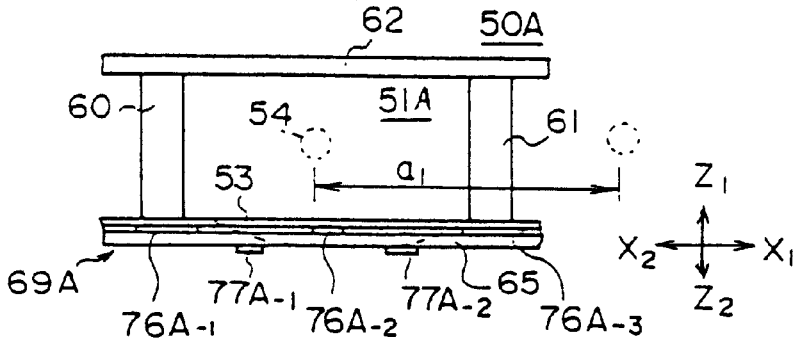
FIG. 4A is a partial front sectional view of an ink jet head according to a second embodiment of the present invention, showing one of a plurality of pressure chambers provided in the ink jet head.
Figure 4B:
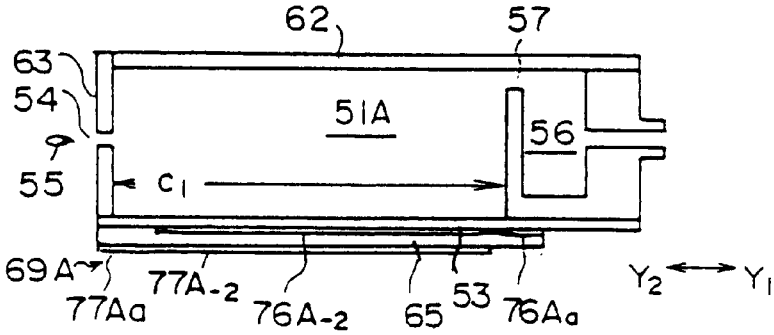
FIG. 4B is a lateral sectional view of the ink jet head of FIG. 4A.
Figure 4C:
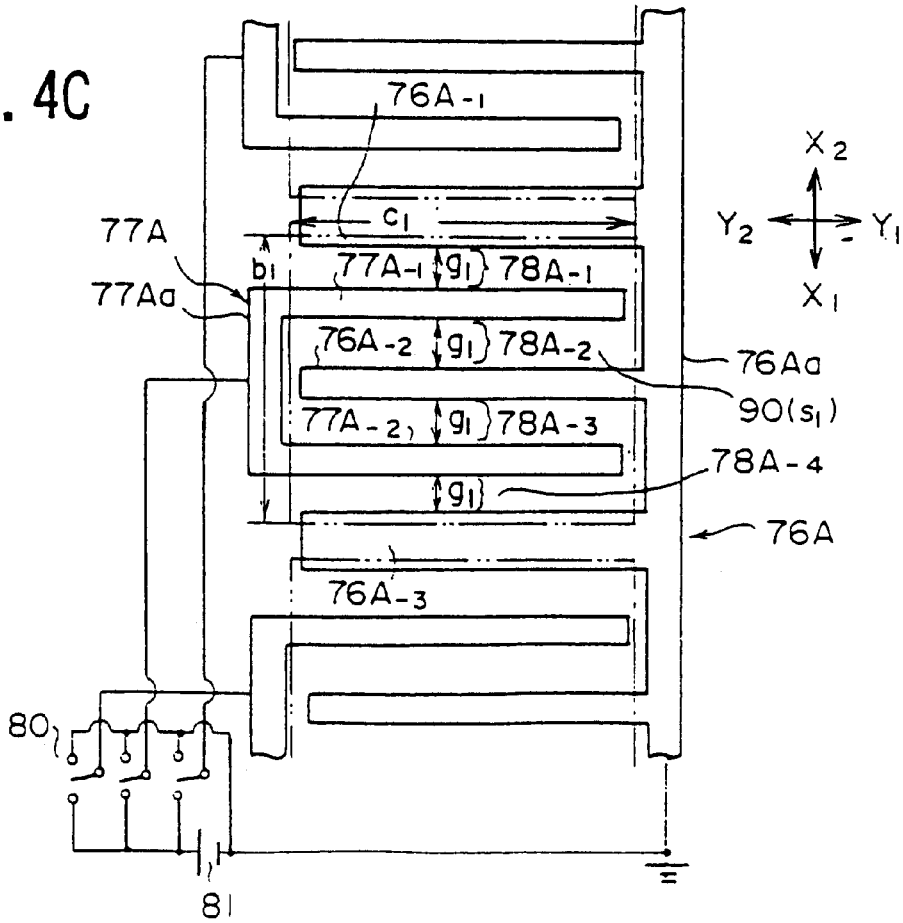
FIG. 4C is a bottom view of the ink jet head of FIG. 4A showing an arrangement of electrode teeth.
Figure 5:
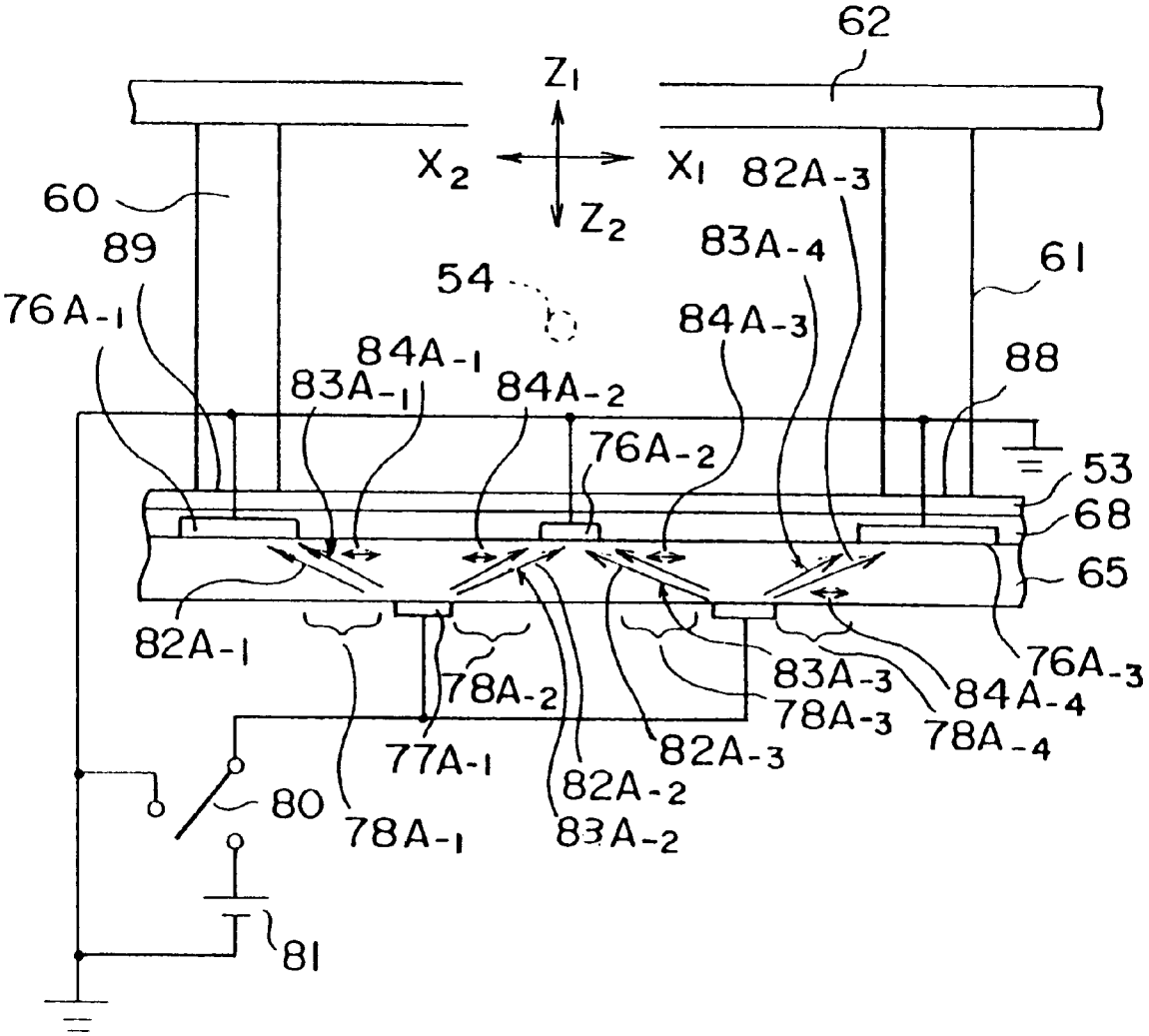
FIG. 5 illustrates formation of electric fields according to the second embodiment.

FIG. 4A is a partial front sectional view of the ink jet head 50 according to a second embodiment of the present invention, showing a pressure chamber 51A of a plurality of pressure chambers provided in the ink jet head 50; FIG. 4B is a lateral sectional view of the ink jet head 50 of FIG. 4A; and FIG. 4C is a bottom view of the ink jet head 50 of FIG. 4A showing an arrangement of electrode teeth. FIG. 5 illustrates formation of electric fields according to the second embodiment. Since the ink jet head 50A has the same construction as the ink jet head 50 of FIGS. 2A–2C except in the arrangement of the individual electrode pattern and the common electrode pattern, the corresponding components are designated by the same reference numerals and the description thereof is omitted.

An individual electrode pattern 77A is formed on the lower surface of the piezoelectric plate member 65. A common electrode pattern 76A is formed on the upper surface of the piezoelectric plate member 65. The common electrode pattern 76A and the individual electrode pattern 77A have a comb-like configuration lying in the Y1–Y2 direction. The common electrode pattern 76A is spaced apart from the individual electrode pattern 77A by a predetermined distance in the Z1–Z2 direction. Each tooth of the comb formed by the common electrode pattern 76A is spaced apart from a respective tooth of the individual electrode pattern 77A by a predetermined distance in the X1–X2 direction. The teeth of the common electrode 76A are connected to each other by a joint part 76Aa.

Three common electrode teeth 76A-1, 76A-2 and 76A-3 of the common electrode pattern 76A are aligned with the left end, the center and the right end of the pressure chamber 51A, respectively. Two individual electrode teeth 77A-1 and 77A-2 of the individual electrode pattern 77A are aligned with the pressure chamber 51A. In a top view, the individual electrode tooth 77A-1 is disposed between the common electrode teeth 76A-1 and 76A-2 in the X1–X2 direction. The individual electrode tooth 77A-2 is disposed between the common electrode teeth 76A-2 and 76A-3 in the X1–X2 direction. That is, the common electrode teeth 76A-1, 76A-2 and 76A-3, and the individual electrode teeth 77A-1 and 77A-2 are arranged in the X1–X2 direction at intervals of g1 in the X1–X2 direction. The individual electrode teeth 77A-1 and 77A-2 are connected to each other by a joint part 77Aa.

The piezoelectric plate member 65 is exposed at the intervals g1. Referring to FIG. 4C, numeral 78A-1 indicates a portion of the piezoelectric plate member 65 between the individual electrode tooth 77A-1 and the common electrode tooth 76A-1; numeral 78A-2 indicates a portion of the piezoelectric plate member 65 between the individual electrode tooth 77A-1 and the common electrode tooth 76A-2; numeral 78A-3 indicates a portion of the piezoelectric plate member 65 between the individual electrode tooth 77A-2 and the common electrode tooth 76A-2; and numeral 78A-4 indicates a portion of the piezoelectric plate member 65 between the individual electrode tooth 77A-2 and the common electrode tooth 76A-3.

The other pressure chambers provided in the ink jet head 50 also have the same construction as described above.

A voltage is applied across the individual electrode pattern 77A and the common electrode pattern 76A so as to induce polarization. The piezoelectric plate member 65 is polarized in the X1–X2 direction in accordance with the arrangement of the individual electrode teeth and the common electrode teeth. The piezoelectric plate member portions 78A-1 and 78A-3 are polarized in the same direction. The piezoelectric plate member portions 78A-2 and 78A-4 are polarized in the same direction. The direction in which the piezoelectric plate member portions 78A-1 and 78A-3 are polarized is opposite to the direction in which the piezoelectric plate member portions 78A-2 and 78A-4 are polarized.

The second embodiment takes advantage of contraction due to the piezoelectric constant d33.

A description will now be given of bulging distortion the bimorph element 69A.

Referring to FIG. 5, when a switch 80 is closed, a positive voltage from a power source 81 is applied to the individual electrode teeth 77A-1 and 77A-2. An electric field 83A-1 indicated by a line of electric force 82A-1 is produced between the individual electrode tooth 77A-1 and the common electrode tooth 76A-1. An electric field 83A-2 indicated by a line of electric force 82A-2 is produced between the individual electrode tooth 77A-1 and the common electrode tooth 76A-2. An electric field 83A-3 indicated by a line of electric force 82A-3 is produced between the individual electrode tooth 77A-2 and the common electrode tooth 76A-2. An electric field 83A-4 indicated by a line of electric force 82A-4 is produced between the individual electrode tooth 77A-2 and the common electrode tooth 76A-3.

X1–X2 direction components of the electric fields 83A-1–83A-4 are larger than the Z1–Z2 direction components thereof.

The Z1–Z2 direction components of the electric fields 83A-1–83A-4 cause the piezoelectric plate member 65 to expand in the direction of the thickness thereof depending on the piezoelectric constant d33 and to contract in the direction along the plane depending on the piezoelectric constant d31. Since the Z1–Z2 direction components of the electric fields 83A-1–83A-4 are relatively small so that the contraction in the direction along the plane due to the Z1–Z2 direction components of the electric fields 83A-1–83A-4 are significantly small, the following description assumes that the contraction in the direction along the plane is negligibly small.

A description will now be given of distortion due to expansion of the piezoelectric plate member 65 in the direction along the plane caused by the electric fields 83A-1–83A-4. As indicated by numeral 84A-1, the piezoelectric plate member portion 78A-1 is efficiently distorted by expansion due to the X1 component of the electric field 83A-1 depending on the piezoelectric constant d33. As indicated by numeral 84A-2, the piezoelectric plate member portion 78A-2 is efficiently distorted by expansion due to the X2 component of the electric field 83A-2 depending on the piezoelectric constant d33. As indicated by numeral 84A-3, the piezoelectric plate member portion 78A-3 is efficiently distorted by expansion due to the X1 component of the electric field 83A-3 depending on the piezoelectric constant d33. As indicated by numeral 84A-4, the piezoelectric plate member portion 78A-4 is efficiently distorted by expansion due to the X2 component of the electric field 83A-4 depending on the piezoelectric constant d33. Accordingly, the piezoelectric plate member 65 is efficiently distorted by expansion in the X1–X2 direction.

The bimorph element 69A has the X1 end thereof secured to the lower surface of the barrier 61 at an anchor part 88 and has the X2 end thereof secured to the lower surface of the barrier 60 at an anchor part 89. Since the bimorph element 69A has the X1 end and the X2 end thereof fixed, expansion of the piezoelectric plate member 65 in the direction along the plane thereof causes the bimorph element 69A to bulge in the Z2 direction so as to have a dome configuration, as indicated by the alternate long and two short dashes line in FIG. 4A. When the switch 80 is grounded, the electric fields 83A-1–83A-4 are removed so that distortion due to expansion and contraction is gone. The bimorph 69A is restored to a flat state due to elasticity of the oscillating plate 53.

When the bimorph element 69A bulges into a dome configuration, the ink inside the common passage 56 is supplied to the pressure chamber 51A via the ink supplying passage 57. When the bimorph element 69A is restored to a flat state, the ink particles 55 (approximately 80 pl) are ejected from the nozzle 54.

By operating another one of the switches 80 of FIG. 4C, the associated portion of the bimorph 69A that corresponds to another pressure chamber is caused to bulge.

Since the individual electrode pattern 77A and the common electrode pattern 76A are formed on the opposite sides of the piezoelectric plate member 65, the lines of electric force 42A-1–42A-4 are formed in the piezoelectric plate member 65 without leaking to the air. Therefore, the electric fields 83A-1–83A-4 are efficiently used when the dome-like bulge occurs.

Since the expansion and contraction due to the piezoelectric constant d33 is utilized, the ink jet head 50A provides the same effect as the ink jet head 50 described above. Thus, the ink jet head 50A is expected to provide improvement in printing resolution and printing speed.

While the ink jet heads according to the first and second embodiments are constructed such that the piezoelectric plate member 65 expands in the direction along the plane due to the X1–X2 direction components of the electric fields, the electric fields may be applied in the opposite direction so that the piezoelectric plate member 65 contracts in the direction along the plane.

The ink jet head may also be constructed such that the oscillating plate 53 is not provided, that is, only the piezoelectric plate member 65 may be provided.

While the ink jet heads according to the first and second embodiments are constructed such that the individual electrode teeth and the common electrode teeth are provided so as to produce four electrode pairs producing respective electric fields for a given pressure chamber, this should not necessarily be so. At least one pair comprising the individual electrode tooth and the common electrode tooth and producing an electric field may be provided for a given pressure chamber.

The oscillating plate 53 may be formed of the same material as the piezoelectric plate member 65 and formed by baking simultaneously with the piezoelectric plate member 65.

The present invention is not limited to the above-described embodiments, and variations and modifications may be made without departing from the scope of the present invention.

What is claimed is:

1. An inkjet head comprising:

a pressure chamber containing ink; a piezoelectric plate member which constitutes a portion of a wall of said pressure chamber and bulges to cause distortion and thereby change the effective volume of said pressure chamber when a voltage is applied to said piezoelectric plate member;

a plurality of first sets of independently energized, mutually spaced electrodes disposed to traverse said piezoelectric plate member; and a second set of commonly energized, mutually spaced electrodes disposed to traverse said piezoelectric plate member; wherein the electrodes of said plurality of first sets and said second set being arranged on alternate disposition across said piezoelectric plate member to produce an electric field in said piezoelectric plate member orientated to have a resultant component extending in a direction along a plane of said piezoelectric plate member so that distortion in the direction along said plane of said piezoelectric plate member due to said resultant component of said electric field causes said piezoelectric plate member to bulge.

2. The ink jet head as claimed in claim 1, wherein each of said plurality of first set of electrodes and each of said second set of electrodes are alternately arranged to traverse a same surface of said piezoelectric plate member at predetermined intervals so that the electric field is produced in an interior of said piezoelectric plate member between adjacent electrodes.

3. The ink jet head as claimed in claim 1, wherein one of said plurality first sets of electrodes and second set of electrodes traverses an upper surface of said piezoelectric plate member and the other of said plurality of first sets and said second set of electrodes traverses a lower surface of said piezoelectric plate member, each of said first set of electrodes and each of said second set of electrodes being alternately arranged in the direction along the plane of said piezoelectric plate member at predetermined intervals, and wherein the electric field is produced in an interior of said piezoelectric plate member between adjacent electrodes.

4. The ink jet head as claimed in claim 1, including an oscillating plate in said pressure chamber and wherein said piezoelectric plate member is adhesively attached to said oscillating plate in a state in which said plurality of first sets of electrodes and said second set of electrodes are formed.

5. An ink jet head comprising:

a pressure chamber containing ink;

a piezoelectric plate member which constitutes a portion of a wall of said pressure chamber and bulges to cause distortion and thereby change the effective volume of said pressure chamber when a voltage is applied to said piezoelectric plate member;

a plurality of first sets of independently energized, mutually spaced electrodes traversing said piezoelectric plate member; and a second set of commonly energized, mutually spaced electrodes traversing said piezoelectric plate member in alternate disposition with respect to said plurality first sets of electrodes; wherein said first set of electrodes and said second set of electrodes are arranged such that an electric field produced in said piezoelectric plate member is orientated to have a resultant component in a direction along a plane of said piezoelectric plate member, said piezoelectric plate member having ends thereof oppositely spaced in the direction along the plane of said plate member fixed, and distortion in the direction along the plane of said piezoelectric plate member due to the resultant component causing said piezoelectric plate member to bulge intermediate said fixed ends thereof.

* * * * *